United States Patent [19]

Kato et al.

[11] Patent Number: 5,049,468

[45] Date of Patent: Sep. 17, 1991

[54] LIQUID DEVELOPERS FOR ELECTROSTATIC PHOTOGRAPHY

[75] Inventors: Eiichi Kato; Kazuo Ishii, both of Shizuoka, Japan

[73] Assignee: Fuji Photo Film Co., Ltd., Kanagawa, Japan

[21] Appl. No.: 427,423

[22] Filed: Oct. 27, 1989

[30] Foreign Application Priority Data

Oct. 28, 1988 [JP] Japan ..... 63-270826

[51] Int. Cl.[5] ..... G03G 9/12

[52] U.S. Cl. ..... 430/115; 430/115

[58] Field of Search ..... 430/114, 119, 137, 115

[56] References Cited

U.S. PATENT DOCUMENTS

| | | | |
|---|---|---|---|
| 4,579,803 | 4/1986 | Kato et al. | 430/114 |
| 4,665,002 | 5/1987 | Dan et al. | 430/137 |
| 4,837,102 | 6/1989 | Dan et al. | 430/137 |
| 4,842,975 | 6/1989 | Kato et al. | 430/137 |

OTHER PUBLICATIONS

Patent Abstracts of Japan, vol. 10, No. 354, Nov. 28, 1986.

Patent Abstracts of Japan, vol. 10, No. 38, Feb. 14, 1986.

*Primary Examiner*—John Goodrow

*Attorney, Agent, or Firm*—Sughrue, Mion, Zinn Macpeak & Seas

[57] ABSTRACT

A liquid developer for an electrostatic photography comprising a non-aqueous solvent whose electrical resistance is at least $10^9$ Ωcm and whose dielectric constant not more than 3.5 with a resin dispersed wherein the dispersed resin particles are copolymer resin particles obtained by a polymerization reaction, of a solution which contains a monofunctional monomer (A) which is soluble in the non-aqueous solvent but which is rendered insoluble by polymerization and a monofunctional macromonomer (B) whose number average molecular weight is not more that $10^4$ obtained by bonding a polymerizable double bond group;

to only one end of the main chain of a polymer in the presence of a soluble resin for dispersion stabilization purposes obtained by bonding an acid group to just one end of at least the polymer main chain.

9 Claims, No Drawings

LIQUID DEVELOPERS FOR ELECTROSTATIC PHOTOGRAPHY

FIELD OF THE INVENTION

This present invention relates to liquid developers for electrostatic photography wherein a resin at least is dispersed in a liquid carrier whose electrical resistance is $10^9$ Ω cm or above and whose dielectric constant is not more than 3.5 and, more precisely, it relates to liquid developers which have excellent redispersion properties, storage properties, stability, image reproduction properties and fixing properties.

BACKGROUND OF THE INVENTION

In general, liquid developers for electrophotographic purposes are obtained by dispersing organic or inorganic pigments or dyes, such as carbon black, nigrosine or phthalocyanine blue, for example, and natural or synthetic resins, such as an alkyd resins, acrylic resins, rosin or synthetic rubbers for example, in a liquid which has good electrically insulating properties and a low dielectric constant, such as a petroleum based aliphatic hydrocarbon, and adding polarity controlling agents such as metal soaps, lecithin, linseed oil higher fatty acids or polymers which contain vinylpyrrolidone for examples.

In developers of this type, the resin is dispersed in the form of insoluble latex particles with a particle diameter from a few nm to a few hundred nm. However, in a conventional liquid developer the bonding between the soluble resin, which is used for dispersion stabilization purposes or the polarity controlling agents and the insoluble latex particles is imperfect. As a result the soluble resins for dispersion stabilization purposes or the polarity controlling agents readily diffuses into the solvent. Consequently, the soluble resins for dispersion stabilization purposes become separated from the insoluble latex particles. On long term storage or repeated use, the particles may sediment, coagulate or lump together. Thus, and the polarity becomes indistinct. Furthermore, it is difficult to redisperse particles once they have been sedimented or formed into lumps and so they tend to become attached to certain parts of the developing apparatus and they may cause contaminate the image parts or cause a breakdown of the developing machine by blocking pumps for example.

It has been suggested that the insoluble latex particles should be chemically bound to the soluble resin for dispersion stabilization purposes in an attempt to eliminate these disadvantages, and disclosures to this effect have been made, for example, in U.S. Pat. No. 3,990,980. However, although such liquid developers are somewhat better in terms of their dispersion stability with respect to the natural sedimentation of the particles, this effect is not sufficient. The redispersion stability still is unsatisfactory. Moreover, when these developers are used in actual developing apparatus there is a problem in that the toner which becomes attached to various parts of the apparatus solidifies in a film like form from which redispersion is difficult. This can be lead to a breakdown of the apparatus and contamination of the transferred images for example. Furthermore, the combinations of dispersion stabilizers and insolubilized monomers which can be used to prepare mono-disperse particles with a narrow particle size distribution is very limited in the methods of manufacture of resin particles disclosed in the above mentioned documents. They tend to be poly-disperse particles which have a wide particle size distribution including large numbers of large, coarse particles or in which two or more average particle sizes are present. Furthermore, it is difficult to obtain particles of the prescribed average particle size in a mono-dispersion which has a narrow particle size distribution, and large particles of at least 1 μm, or very fine particles of less than 0.1 μm, are formed. Moreover, there is a further problem in that the dispersion stabilizers which are used must be prepared using a complicated and time consuming process.

Additionally, methods of overcoming the above mentioned problems in which the degree of dispersion of the particles, the redispersion properties and the storage properties are improved by using insoluble dispersed resin particles consisting of copolymers of insolubilized monomers and monomers which contain long chain alkyl groups or monomers which contain two or more polar components are disclosed, for example, in JP-A-60-179751 and JP-A-62-151868. (The term "JP-A" as used herein signifies an "unexamined published Japanese patent application").

On the other hand, techniques in which more than 5000 copies are printed using offset printing master plates obtained using electrophotographic techniques have been introduced in recent years. In particular, progress has been made in improving the master plates so that it is now possible to print in excess of 10,000 copies even with large plate sizes. Furthermore, progress has been made in shortening the operating time of the electrophotographic plate making system where improvements have been actuated in speeding up of the development/fixing processes.

The dispersed resin particles manufactured using the procedures disclosed in the aforementioned JP-A-60-179751 and JP-A-62-151868 do not always provide satisfactory performance in terms of particle dispersion properties and redispersion properties when development speeds are increased and in terms of printing resistance when the fixing time is shortened or when the master plate is large (for example A3 size or greater).

The problems encountered with conventional liquid developers of the type described above are resolved by this invention.

SUMMARY OF THE INVENTION

An object of the present invention is to provide liquid developers which have excellent dispersion stability, redispersion properties and fixing properties even in electrophotographic printing plate making systems which involve high speed development and fixing and in which large size master plates are used.

Another object of the present invention is to provide liquid developers with which it is possible to form, by means of an electrophotographic process, offset printing original plates which have excellent printing ink receptivity and printing durability (printing press life).

A further object of the present invention is to provide liquid developers which, in addition to the aforementioned applications, are appropriate for use in a variety of electrostatic photographic applications and copying applications.

Moreover, an object of this invention is to provide liquid developers which can be used in systems in which liquid developers are used for ink jet recording, cathode ray tube recording and for recordings made, for example, when changes in pressure occur, or, when electrostatic variations occur.

The above mentioned objects of the present invention are by a liquid developer for an electrostatic photographic process in which a resin at least is dispersed in a non-aqueous solvent whose electrical resistance is at least $10^9$ Ω cm and whose dielectric constant not more than 3.5 wherein the dispersed resin particles are copolymer resin particles obtained by a polymerization reaction, of a solution which contains a monofunctional monomer (A) which is soluble in the non-aqueous solvent but which is rendered insoluble by polymerization and a monofunctional macromonomer (B) whose number average molecular weight is not more than $10^4$ obtained by bonding a polymerizable double bond group represented by the general formula (III) below;

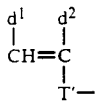

(III)

In general formula (III), T′ has the same significance as T in general formula (II). Moreover, $d^1$ and $d^2$ may be the same or different, each having the same significance as $b^1$ and $b^2$ in general formula (II); to only one end of the main chain of a polymer comprising repeating units which can be represented by the general formula (II) indicated below;

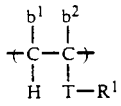

(II)

wherein T represents —COO—, —OCO—, —$CH_2$OCO—, —$CH_2$COO—, —O—, —$SO_2$—,

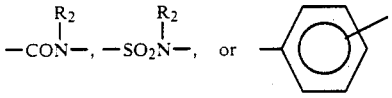

where $R_2$ represents a hydrogen atom or a hydrocarbyl group which has from 1 to 18 carbon atoms; $R_1$ represents a hydrocarbyl group which has from 1 to 22 carbon atoms; and $b^1$ and $b^2$, which may be the same or different, each represents a hydrogen atom, a halogen atom, a cyano group, a hydrocarbyl group which has from 1 to 8 carbon atoms, a —COO—$R^3$ group or a —COO—$R^3$ group which is linked via a hydrocarbyl group which has from 1 to 8 carbon atoms, where $R^3$ represents a hydrogen atom or a hydrocarbyl group which has from 1 to 18 carbon atoms; in the presence of a soluble resin for dispersion stabilization purposes obtained by bonding an acid group selected from the group consisting of —$PO_3H_2$, —$SO_3H$, —COOH, —OH, —SH and

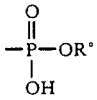

to just one end or terminal of at least the polymer main chain of a polymer which has a repeating unit which can be represented by the general formula (I) below;

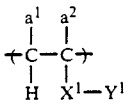

(I)

wherein $X^1$ represents —COO—, —OCO—, —$CH_2$OCO—, —$CH_2$COO—, —O— or —$SO_2$—;

$Y^1$ represents an aliphatic group which has from 6 to 32 carbon atoms; and $a^1$ and $a^2$, which may be the same or different, each represents a hydrogen atom, a halogen atom, a cyano group, a hydrocarbyl group which has from 1 to 8 carbon atoms, a —COO—$Z^1$ group or a —COO—$Z^1$ group which is linked via a hydrocarbyl group which has from 1 to 8 carbon atoms, where $Z^1$ represents a hydrocarbyl group which has from 1 to 22 carbon atoms; and of which a part is crosslinked, in the non-aqueous solvent.

DETAILED DESCRIPTION OF THE INVENTION

The liquid developers of this present invention are described in detail below.

The use of linear chain or branched aliphatic hydrocarbons, alicyclic hydrocarbons or aromatic hydrocarbons, and halogen substituted derivatives thereof, is preferred for the carrier liquid of which the electrical resistance is at least $10^9$ Ω cm and of which the dielectric constant is not more than 3.5 which is used in the invention. For example, octane, iso-octane, decane, iso-decane, decalin, nonane, dodecane, iso-dodecane, cyclohexane, cyclo-octane, cyclodecane, benzene, toluene, xylene, mesitylene, "Isopar E", "Isopar G", "Isopar H", "Isopar L", ("Isopar" is a trade name of the Exxon Co.), "Shellsol 70", "Shellsol 71", ("Shellsol" is a trade name of the Shell Oil Co.), "Amsco OMS", and "Amsco 460" solvent ("Amsco" is a trade name of the spirits Co.) can be used individually or in the form of mixtures or this purpose.

The non-aqueous dispersions of resin particles (referred to hereinafter as "latex particles") which are a most important component in the present invention are prepared in a non-aqueous solvent by the copolymerization (a so-called polymerization particle forming method) of the afore-mentioned monofunctional monomer (A) and monofunctional macromonomer (B) in the presence of the afore-mentioned resin for dispersion stabilization purposes which has an acid group selected from —$PO_3H_2$, —$SO_3H$, —COOH, —OH, —SH and

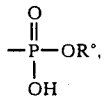

where $R^0$ represents a hydrocarbyl group, bound to one end of at least the main chain of a polymer which has repeating unit which can be represented by the aforementioned general formula [I] and of which part of the polymer chain is crosslinked.

Here, any non-aqueous solvent can be used provided that it is basically miscible with the carrier liquid of the aforementioned liquid developer for electrophotographic purposes.

That is to say, the solvents which can be used when preparing the dispersed resin particles should be miscible with the aforementioned carrier liquids, and the use of linear chain or branched aliphatic hydrocarbons, alicyclic hydrocarbons, aromatic hydrocarbons and halogen substituted derivatives thereof is preferred. For example, solvents such as hexane, octane, iso-octane, decane, iso-decane, decalin, nonane, dodecane, iso-dodecane, "Isopar E", "Isopar G", "Isopar H", "Isopar L", "Shellsol 70", "Shellsol 71", "Amsco OMS" and "Amsco 460" can be used individually or in the form of mixtures for this purpose.

Solvents which can be used as mixtures wit these organic solvents include alcohols (for example, methyl alcohol, ethyl alcohol, propyl alcohol, butyl alcohol, fluorinated alcohol), ketones (for example, acetone, methyl ethyl ketone, cyclohexanone), carboxylic acid esters (for example, methyl acetate, ethyl acetate, propyl acetate, butyl acetate, methyl propionate, ethyl propionate), ethers (for example, diethyl ether, dipropyl ether, tetrahydrofuran, dioxane), and halogenated hydrocarbons (for example, methylene dichloride, chloroform, carbon tetrachloride, dichloroethane and methylchloroform).

These non-aqueous solvents which are used in admixture are preferably distilled off by heating or by reducing the pressure after the particles have been formed by polymerization, but they may be included in the latex particle dispersion for the liquid developer without causing problems provided that the requirement of a developer liquid resistance of at least $10^9$ Ω cm is satisfied.

The use during the preparation of the resin dispersion of the same solvent as that used for the carrier liquid is normally preferred and, as mentioned earlier, it is possible to use linear or branched chain aliphatic hydrocarbons, alicyclic hydrocarbons, aromatic hydrocarbons and halogenated hydrocarbons, for example, for this purpose.

The resin for dispersion stabilization purposes in this invention which is used to form the solvent insoluble copolymer obtained by copolymerizing monomer (A) and macromonomer (B) into a stable resin dispersion is a polymer which is soluble in the non-aqueous solvent in which an acid group selected from $-PO_3H_2$, $-SO_3H$, —COOH, —OH, —SH and

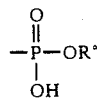

where $R^0$ represents a hydrocarbyl group is bonded to just one end of at least the main chain of a polymer comprising repeating units represented by the aforementioned general formula (I) and in which part of the polymer chain is crosslinked.

The repeating unit represented by general formula (I) is described in more detail below.

The aliphatic groups and hydrocarbyl groups in the repeating units represented by general formula (I) may be substituted.

In general formula (I), $X^1$ reprsents —COO—, —OCO—, $-CH_2OCO-$, $-CH_2COO-$ or —O— and, most preferably, $X^1$ represents —COO—, $-CH_2COO-$ or —O—.

$Y^1$ preferably represents an aralkyl group, alkenyl group or alkyl group which has from 8 to 22 carbon atoms and which may be substituted. Examples of substituent groups include halogen atoms (for example, fluorine, chlorine, bromine), $-O-Z^2$, $-COO-Z^2$, and $-OCO-Z^2$ (where $z^2$ represents an alkyl group which has from 6 to 22 carbon atoms, for example, hexyl, octyl, decyl, dodecyl, hexadecyl, octadecyl). Most preferably $Y^1$ represents an alkenyl group or an alkyl group which has from 8 to 22 carbon atoms, for example, octyl, decyl, dodecyl, tridecyl, tetradecyl, hexadecyl, octadecyl, docosanyl, octenyl, decenyl, dodecenyl, tetradecenyl hexadecanyl or octadecenyl.

Moreover, $a^1$ and $a^2$ may be the same or different, and they preferably represent hydrogen atoms, halogen atoms (for example, fluorine, chlorine, bromine), cyano groups, alkyl groups which have from 1 to 3 carbon atoms, $-COO\ Z^1$ groups or $-CH_2COO-Z^1$ groups (where $Z^1$ preferably represents an aliphatic group which has from 1 to 22 carbon atoms, for example, methyl, ethyl, propyl butyl, hexyl, octyl, decyl, dodecyl, tridecyl, tetradecyl, hexadecyl, octadecyl, docosenyl, pentenyl, hexenyl, heptenyl, octenyl, decenyl, dodecenyl, tetradecenyl, hexadecenyl, octadecenyl, and these aliphatic groups may have the same substituent groups as the aforementioned $Y^1$ group). More preferably, $a^1$ and $a^2$ each represent a hydrogen atom, an alkyl group which has from 1 to 3 carbon atoms (for example, methyl, ethyl, propyl), a $-COO-Z^3$ group or a $-CH_2COO-Z^3$ group (where $Z^3$ more preferably represents an alkenyl group or an alkyl group which has from 1 to 12 carbon atoms, for example, methyl, ethyl, propyl, butyl, hexyl, octyl, decyl, dodecyl, pentenyl, hexenyl, heptenyl, octenyl or decenyl, and these alkyl and alkenyl groups may have the same substituent groups as the afore-mentioned $Y^1$ group).

The resin for dispersion stabilization purposes of this invention which is used to form the solvent insoluble copolymer formed by copolymerizing monomer (A) and macromonomer (B) into a stable dispersion is a resin which does not contain graft groups which is polymerized with monomer (A) and macromonomer (B), being a polymer which has at least one repeating unit represented by the general formula (I) and in which parts are crosslinked, and in which at least one acid group selected from a carboxyl group, a sulfo group, a phosphono group, a hydroxyl group, a mercapto group and a

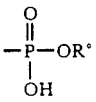

group [where $R^0$ is preferably a hydrocarbyl group which has from 1 to 18 carbon atoms {more preferably an aliphatic group which has from 1 to 8 carbon atoms, which may have a substituent (such as methyl, ethyl, propyl, butyl, hexyl, octyl, 2-chloroethyl, 2-methoxyethyl, butenyl, pentenyl, hexenyl, benzyl, phenethyl, bromobenzyl, methoxybenzyl, chlorobenzyl, methylbenzyl, cyclopentyl, cylcohexyl), or an aryl group having 6 to 10 carbon atoms, which may have a substituent (such as phenyl, tolyl, xylyl, chlorophenyl, bromophenyl, methoxyphenyl, ethylphenyl, methoxycerbonylphenyl)}] is bonded to just one end of at least the polymer main chain. Here, the acid group may have a chemical structure such that it is bound directly or via an optional linking group to one end of the polymer main chain.

These linking groups can have a structure comprising any combination of atomic groups including carbon—carbon bonds (single or double bonds), carbon—hetero atom bonds (where the hetero atom is oxygen, sulfur, nitrogen or silicon, for example), and hetero atom—hetero atom bonds. For example, the linking group may be a single linking group selected from a

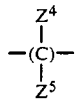

group [where $Z^4$ and $Z^5$ represent hydrogen atoms, halogen atoms (for example, fluorine, chlorine, bromine), cyano groups, hydroxyl groups, alkyl groups (for example, methyl, ethyl, propyl)],

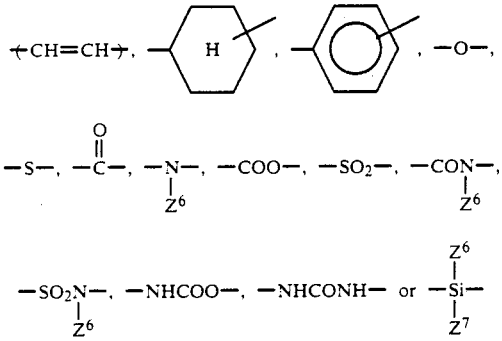

[where $Z^6$ and $Z^7$ each represents a hydrogen atom or a hydrocarbyl group which has the same meaning as $Z^1$ in the afore-mentioned general formula (I), or any combination of these groups].

The polymer components of the resins for dispersion stabilization purposes of this present invention are polymers which contain a homopolymer component or a copolymer component of repeating units selected from those represented by the general formula (I) or a copolymer component obtained by polymerizing monomers corresponding to repeating units represented by general formula (1) and other polymerizable monomers, and in which parts are crosslinked. Conventional well known methods can be used for introducing the crosslinked structure into the polymer. Thus, methods in which the polymerization of the monomer is carried out in presence of a polyfunctional monomer and methods in which functional groups, with which a crosslinking reaction can be achieved, are included in the polymer and crosslinking is carried out in the polymerization reaction are used therefor.

From the point of view of simplicity of the manufacturing procedure e.g., preventing from taking long reaction time, incorporation of impurities, e.g., due to use of reaction accelerators, non-quantitative procedures, etc, crosslinking reactions by polymerization or using the functional groups $—CONHCH_2OZ^8$ (where $Z^8$ represents a hydrogen atom or an alkyl group) which give rise to self-crosslinking reactions are effective for the dispersion stabilization resin of the invention.

Methods in which crosslinks are formed between the polymer chains by polymerizing monomers which have two or more polymerizable functional groups together with monomers corresponding to the repeating units represented by the aforementioned formula (I) are preferred. Specific examples of polymerizable functional groups include

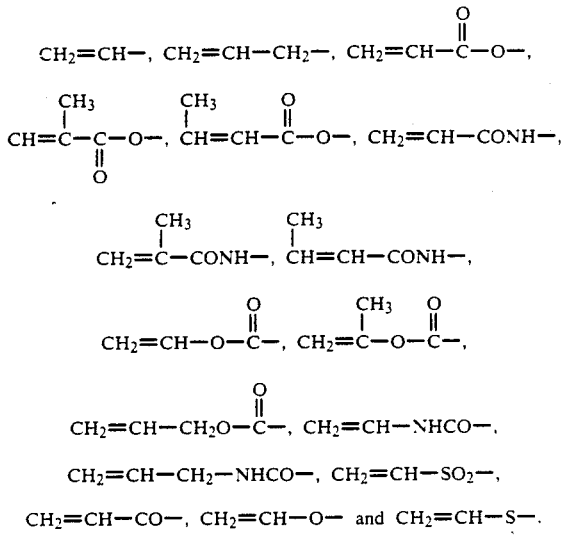

The monomers which have two or more of the above mentioned polymerizable functional groups may be monomers which have two or more of the same polymerizable functional group or monomers which have two or more different polymerizable functional groups.

Specific examples of monomers which have two or more polymerizable functional groups include, as monomers in which the functional groups are the same, styrene derivatives such as divinylbenzene and trivinylbenzene, methacrylic acid, acrylic acid or crotonic acid esters, vinyl esters, or allyl esters, of polyhydric alcohols (for example, ethylene glycol, diethylene glycol, triethylene glycol, polyethylene glycol, #200, #400, #600, 1,3-butylene glycol, neopentyl glycol, dipropylene glycol, polypropylene glycol, trimethylolpropane, trimethylolethane, pentaerythritol) or polyhydroxyphenols (for example, hydroquinone, resorcinol, catechol, and derivatives thereof), vinyl esters or allyl esters, or vinylamides or allyl amides, of dibasic acids (for example, malonic acid, siccinic acid, glutaric acid, adipic acid, pimelic acid, maleic acid, phthalic acid, itaccnic acid), and condensates of polyamines (for example, ethylenediamine, 1,3-propylenediamine, 1,4-butylenediamine) and carboxylic acids which contain vinyl groups (for example, methacrylic acid, acrylic acid, crotonic acid, allylacetic acid).

Furthermore, examples of monomers which have different polymerizable functional groups include vinyl-group-containing ester and amide derivatives derived from carboxylic acids which contain vinyl groups [for example, methacrylic acid, acrylic acid, methacryloylacetic acid, acryloylacetic acid, methacryloylpropionic acid, acryloylpropionic acid, itaconyloylacetic acid, itaconylpropionic acid and the reaction products of alcohols or amines with carboxylic acid anhydrides (for example, allyloxycarbonylpropionic acid, allyloxycarbonylacetic acid, 2-allyloxycarbonylbenzoic acid, allylaminocarbonylpropionic acid)], (for example, vinyl methacrylate, vinyl acrylate, vinyl itaconate, allyl methacrylate, allyl acrylate, allyl itaconate, vinyl methacryloylacetate, vinyl methacryloylpropionate, allylmethacryloylpropionate, vinyloxycarbonylmethyl methacrylate, vinyloxycarbonylmethyloxycarbonylethylene acrylate, N-allylacrylamide, N-allylmethacrylamide, N-allylitaconic acid amide, methacryloylpropionic acid allyl amide), and vinyl-group-containing ester derivatives or amide derivatives which are derived from condensates of carboxylic acids which contain vinyl groups with aminoalcohols (for example, aminoethanol, 1-aminopropanol, 1-aminobutanol, 1-aminohexanol, 2-aminobutanol).

Monomers which have two or more polymerizable functional groups which are used in the invention are used at a rate of not more than 15 wt %, and preferably at a rate of not more than 10 wt %, with respect to the total weight of monomer to form the resins for dispersion stabilization purposes which are soluble in non-aqueous solvents of this present invention.

Furthermore, the resins for dispersion stabilization purposes of the present invention which nave a specified acidic group bonded to just one end of at least one polymer main chain can be prepared easily using methods of synthesis such as those in which various reagents are reacted with the ends of living polymers obtained using conventional anionic or cationic polymerization (ionic polymerization methods), those in which radical polymerization is carried out using polymerization initiators and/or chain transfer reagents which contain the specified acid groups within the molecule (radical polymerization methods) and those in which polymers which contain reactive terminal groups obtained by ionic polymerization or radical polymerization methods as described above are converted to polymers which contain the specified acid groups by means of a polymer reaction.

Specific examples of preparation methods include those disclosed in P. Dreyfuss and R. P. Quirk, *Encycl. Polym. Sci. Eng.*, 7, 551 (1987), Nakajo and Yarashita, *Senryo to Yakuhin*, 30, 232 (1985), and *Ueda and Nagai, Kagaku to Kogyo*, 60, 57 (1986) and in the literature cited therein.

The weight average molecular weight of the resins for dispersion stabilization purposes of this present invention is preferably from $1\times10^4$ to $6\times10^5$, and most preferably from $2\times10^4$ to $3\times10^5$. With a weight average molecular weight of less than $1\times10^4$, the average particle size of the resin grains obtained on forming particles by polymerization increases (for example, exceeding 0.5 μm), and the grain size distribution is widened. Furthermore, when the weight average molecular weight exceeds $6\times10^5$ the average particle size of the resin particles obtained by polymerization increases and it is difficult to provide an average particle size within the preferred range of from 0.15 to 0.4 μm.

The resin polymers for dispersion stabilization purposes which are used in this present invention can be prepared using various methods. For example, they can be prepared using (1) methods in which mixtures comprised of monomers which correspond to the repeating unit represented by the general formula (I), the above mentioned polyfunctional monomers and chain transfer agents which contain the acid groups are polymerized with a polymerization initiator (for example an azobis compound or a peroxide), (2) methods in which polymerization is carried out without the use of the above mentioned chain transfer agents using polymerization initiators which contain the acidic groups, (3) methods in which compounds which contain the acidic groups are used both as chain transfer agents and polymerization initiators, and (4) methods in which, in the three methods aforementioned, a compound which contains an amino group, a halogen atom, an epoxy group or an acid halide group, for example, as a substituent of a chain transfer agent or a polymerization initiator is used and, after polymerization, the acid groups are introduced by reaction using the functional groups in a polymer reaction.

Chain transfer agents which can be used include mercapto compounds which have acid groups or substituent groups from which the acid groups can be derived (for example, thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-( 2-mercaptoethyl)carbamoyl]propionic acid, 3-[N-(2-mercaptoethyl)amino]propionic acid, N-(3-mercaptoproprionyl)alanine, 2-mercaptoethanesulfonic acid, 3-mercaptopropanesulfonic acid, 4-mercaptobutanesulfonic acid, 2-mercaptoethanol, 3-mercapto-1, 2-propanediol, 1-mercapto-2-propanol, 3-mercapto-2-butanol, mercaptophenol, 2-mercaptoethylamine, 2-mercaptoimidazole, 2-mercapto-3-pyridinol), or alkyl iodide compounds which contain the above mentioned acid groups or substituents (for example, iodoacetic acid, iodopropionic acid, 2-iodoethanol, 2-iodoethanesulfonic acid, 3-iodopropanesulfonic acid). Use of the mercapto compounds is preferred.

These chain transfer agents or polymerization initiators are used at a rate of from 0.1 to 15 wt %, and preferably at a rate of from 0.5 to 10 wt %, with respect to the total amount of monomer in each case.

While not desiring to be bound, the resins for dispersion stabilization purposes of this present invention which have been prepared in the manner described above are thought to have markedly improved interaction with the insoluble resin particles due to acid groups which are bound to just one end of the polymer main chains and markedly improved compatibility with non-aqueous solvents because of the fact that the components which are soluble in non-aqueous solvents are crosslinked, and as a result it is thought that they will inhibit coagulation and sedimentation of the insoluble particles and markedly improve the redispersion properties of the insoluble particles.

The monomers used when preparing the non-aqueous based dispersed resins can be monofunctional monomers (A) which are soluble in the non-aqueous solvents but which are rendered insoluble by polymerization, and mono-functional macromonomers (B) which form copolymers with the mono-functional monomers (A).

Monofunctional monomer (A) of this invention may be any monofunctional monomer which is soluble in the non-aqueous solvents and rendered insoluble by polymerization. Specific examples of such monomers include those represented by the general formula (IV).

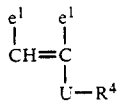

(IV)

In general formula [IV], U represents —COO—, —OCO—,

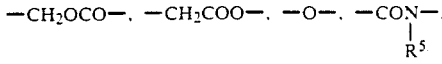

-continued

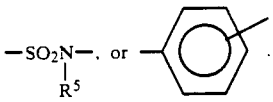

Here, $R^5$ represents a hydrogen atom or an aliphatic group which has from 1 to 18 carbon atoms and which may be substituted (for example, methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, 3-methoxypropyl).

$R^4$ represents a hydrogen atom or an aliphatic group which has from 1 to 6 carbon atoms which ray have a substituent (for example, methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cylcopentyl, chlorocyclohexyl, dichlorohexyl).

Moreover, $e^1$ and $e^2$ may be the same or different and each has the same meaning as $b^1$ or $b^2$ in the aforementioned general formula (II).

Specific examples of the monofunctional monomer (A) include the vinyl esters or allyl esters of aliphatic carboxylic acids which have from 1 to 6 carbon atoms (for example, acetic acid, propionic acid, butyric acid, monochloroacetic acid, trifluoropropionic acid) alkyl esters, wherein the alkyl groups have from 1 to 4 carbon atoms and may be substituted (examples of such alkyl groups include methyl, ethyl, propyl, butyl, 2-chloroethyl, 2-bromoethyl, 2-fluoroethyl, trifuloroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 3-pyridinylethyl, 2-thienylethyl, trimethoxysilylpropyl and 2-carboxyamidoethyl), or amides, of unsaturated carboxylic acids such as, for example, acrylic acid, methacrylic acid, crotonic acid, itaconic acid and maleic acid; styrene derivatives (for example, styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminoethylstyrene, vinylbenzenecarboxamide, vinylbenzenesulfoamide); unsaturated carboxylic acids, such as acrylic acid, methacrylic acid, crotonic acid, maleic acid or itaconic acid, for example, or cyclic anhydrides of maleic acid or itaconic acid, acrylonitrile, methacrylonitrile, and heterocyclic compounds which contain a polymerizable double bond (specific examples include the compounds disclosed in *Polymer Data Handbook, Fundamentals Edition*, Macromolecular Society, pages 175–184 published by Baifukan (1986), for example N-vinylpyridine, N-vinylimidazole, N-vinylpyrrolidone, vinylthiophene, vinyltetrahydrofuran, vinyloxazoline, vinylthiazole and N-vinylmorpholine).

Two or more of monofunctional monomers (A) can be used in combination.

Monofunctional macromonomer (B) is a macromonomer of number average molecular weight not more than $10^4$ which has a polymerizable double bond group represented by the general formula (III) which capable of polymerization with monomer (A) bound only to one end of a polymer main chain comprising repeating units represented by the general formula (II).

Suitable hydrocarbyl groups for $b^1$, $b^2$, T, $R^1$, $d^1$, $d^2$ and T' in general formulae (II) and (III) have the carbon atoms (for the unsubstituted hydrocarbyl groups) indicated in each case, and these hydrocarbyl groups may be substituted hydrocarbyl groups.

In general formula (II), the $R^2$ substituent groups in the substituent groups represented by T may be a hydrogen atom, but they are preferably alkyl groups which have from 1 to 18 carbon atoms (for example, methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, 3-bromopropyl), alkenyl groups which have from 4 to 18 carbon atoms, (for example, 2-ethyl-1-propenyl, 2-butenyl, 2-pentenyl, 3-methyl-2-pentenyl, 1-pentenyl, 1-hexenyl, 2-hexenyl, 4-methyl-2-hexenyl), aralkyl groups which have from 7 to 12 carbon atoms (for example, benzyl, phenethyl, 3-phenylpropyl, naphthylmethyl, 2-naphthylethyl, chlorobenzyl, boromobenzyl, methylbenzyl, ethylbenzyl, methoxybenzyl, dimethylbenzyl, dimethoxybenzyl), alicyclic groups which have from 5 to 8 carbon atoms (for example, cyclohexyl, 2-cyclohexylethyl, 2-cyclopentylethyl), or aromatic groups which may be substituted and which have from 6 to 12 carbon atoms (for example, phenyl, naphtyl, tolyl, xylyl, propylphenyl, butylhenyl, octylphenyl, dodecylphenyl, methoxyphenyl, ethoxytphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxy-carbonylphenyl, acetamidophenyl, propioamidophenyl, dodecyloylamidophenyl).

Where T represents

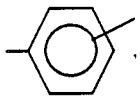

the benzene ring may have substituent groups. These substituent groups include halogen atoms (for example, chlorine, bromine) and alkyl groups (for example, methyl, ethyl, propyl, butyl, chloromethyl, methoxymethyl.

$R_1$ preferably represents a hydrocarbyl group which has from 1 to 18 carbon atoms, and more sepcifically $R^1$ represents the same hydrocarbyl groups as described above for $R^2$.

Moreover, $b^1$ and $b^2$ may be the same or different and each preferably represents a hydrogen atom, a halogen atom (for example chlorine, bromine), a cyano group, an alkyl group which has from 1 to 3 carbon atoms (for example, methyl, ethyl, propyl), a —COO—$R^3$ group or a —$CH_2COOR^3$ group (where $R^3$ represents a hydrogen atom or an aryl group, an alicyclic group, an aralkyl group, an alkenyl group, or an alkyl group which has from 1 to 18 carbon atoms and which may be substituted groups, and specific examples include those described above for $R^2$).

In general formula (III), T' has the same meaning as T in formula (II), and $d^1$ and $d^2$ may be the same or different and have the same meaning as $b^1$ and $b^2$ in the above mentioned formula (II). Preferred examples for T', $d^1$ and $d^2$ are the same as those described above for T, $b^1$ and $b^2$ respectively.

It is preferred that either one of $b^1$ and $b^2$ in formula (II) or $d^1$ and $d^2$ in formula (III) is a hydrogen atom.

As described above, the macromonomer used in this invention has a chemical structure such that a polymerizable double bond group represented by the general formula (III) is bonded directly, or via an optional linking group, to just one end of a polymer main chain comprised of repeating units represented by general formula (II). The groups which link the unit of formula (II) and the unit of formula (III) are constructed form any combination of groups of atoms which have carbon—carbon bonds (single bonds or double bonds), carbon—hetero atom bonds (where the hetero atom is oxygen, sulfur, nitrogen or silicon, for example), and hetero atom —hetero atom bonds.

Preferred macromonomers (B) of this invention are represented by the formula (V).

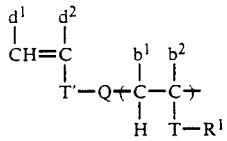

(V)

In formula (V), $b^1$, $b^2$, $d^1$, $d^2$, T, $R_1$ and T' each have the same meaning as described in connection with formulae (II) and (III).

Q represents a single bond or a linking group comprising a single linking group or an optional combination of linking groups selected from groups of atoms such as

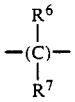

[where $R^6$ and $R^7$ each represents a hydrogen atom, a halogen atom (for example, fluorine, chlorine, bromine), a cyano group, a hydroxyl group, an alkyl group (for example, methyl, ethyl, propyl)],

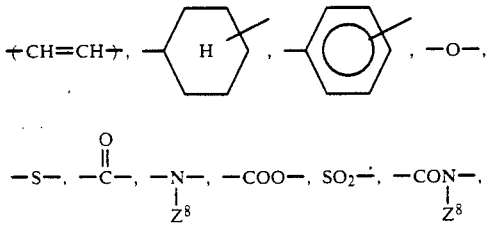

-continued

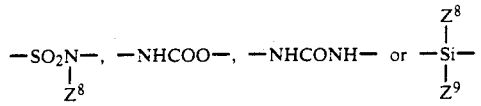

[where $Z^8$ and $R^9$ each represent a hydrogen atom or a hydrocarbyl group which has the same meaning as the aforementioned $R^2$ group].

An appropriate number average molecular weight for macromonomer (B) range from $1\times10^3$ to $1\times10^4$. Printing durability falls if the upper limit for the number average molecular weight of macromonomer (B) exceeds $1\times10^4$. On the other hand, there is a tendency for contamination to arise if the molecular weight is too low and so a molecular weight of at least $1\times10^3$ is preferred.

Especially preferred examples of T, $R^1$, T', $b^1$, $b^2$, $d^1$ and $d^2$ in the aforementioned general formulae (II), (III), and (V) are described below.

More specifically, T is preferably —COO—, —OCO—, —O—, —$CH_2$COO— or —$CH_2$OCO—, $R_1$ is preferably an alkenyl group or an alkyl group which has up to 18 carbon atoms, T' is preferably any of the groups aforementioned (but in which $R^2$ is a hydrogen atom), and $b^1$, $b^2$, $d^1$, and $d^2$ are preferably hydrogen atoms or methyl groups.

Macromonomers (B) of this present invention can be prepared using conventional methods of synthesis. For example, they can be prepared using methods in which various reagents are reacted with the end of a living polymer which is obtained using anionic polymerization or cationic polymerization to form a macromer using an ionic polymerization method, methods in which various reagents are reacted with living polymers which have reactive terminal groups obtained by radical polymerization using polymerization initiators and/or chain transfer agents which contain reactive groups such as carboxyl groups, hydroxyl groups or amino groups, for example, within the molecule and forming the macromer using of radical polymerization, and methods in which the polymerizable double bond groups are introduced into poly-addition or poly-condensation polymers in the same manner in the above mentioned radical polymerization methods, being introduced into oligomers which have been obtained by poly-addition or poly-condensation reactions.

More specifically, macromonomers (B) can be prepared using the methods disclosed in P. Dreyfuss & R. P. Quirk, *Encycl. Polym,. Sci. Eng.*, 7, 551, (1987), P. F. Rempp & E. Franta, *Adv. Polym. Sci.*, 58, 1 (1984), V. Percec, *Appl. Polym. Sci.*, 285, 95 (1984), R. Asami, M. Takari, *Makramol. Chem. Suppl.*, 12, 163, (1985), Kawakami, *Kagaku Kogyo*, 38, 56 (1987), Yamashita, *Kobunshi*, 31 988 (1982), Kobayashi, *Kobunshi*, 30, 625 (1981), Higashimura, *Nippon Setchaku Kyokaishi*, 18, 536 (1982), Ityo, *Kobunshi kako*, 35, 262 (1968), and Azuma & Tsuda, *Kino Zairyo*, 1987, No. 10, 5, and in the literature and patents cited therein.

Specific examples of macromonomers (B) of this present invention include the compounds indicated below. However, the scope of this invention is not limited by these examples.

(B)-1
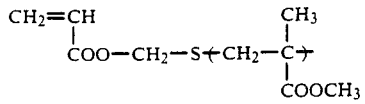
(B)-2
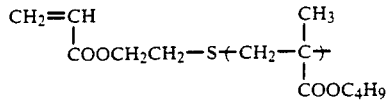
(B)-3
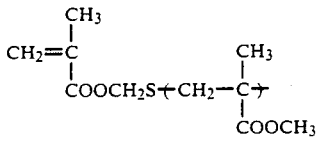
(B)-4
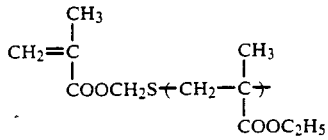
(B)-5
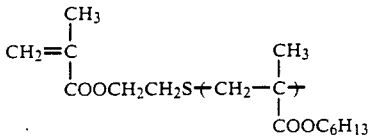
(B)-6
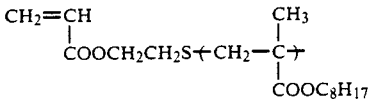
(B)-7
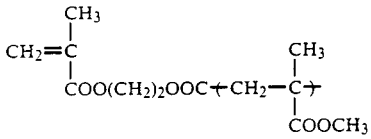
(B)-8
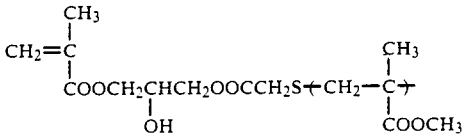
(B)-9
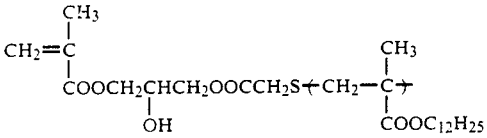
(B)-10
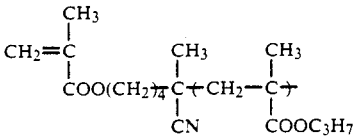
(B)-11
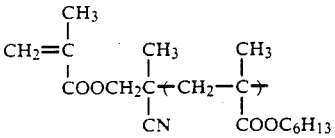
(B)-12
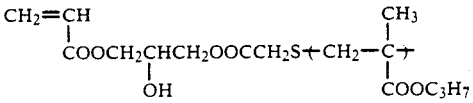
(B)-13
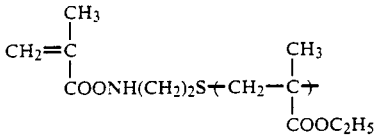
(B)-14
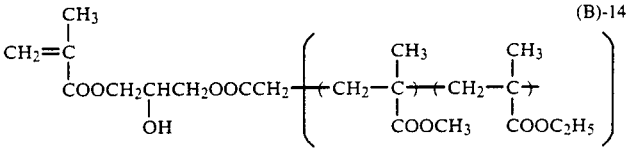
(B)-15
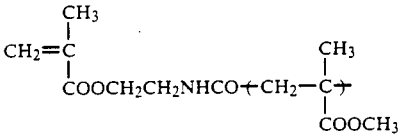
(B)-16
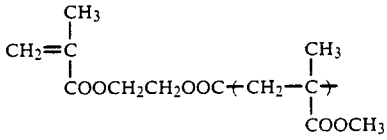
(B)-17
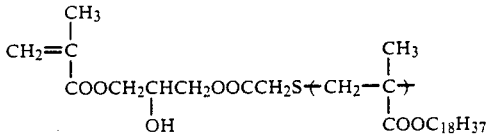
(B)-18
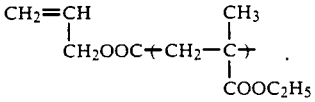
(B)-19
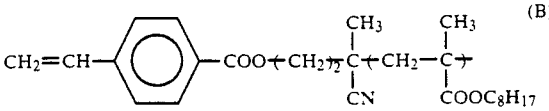
(B)-20
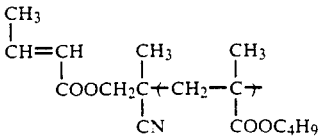

-continued (B)-21

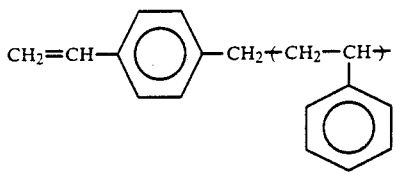

(B)-22

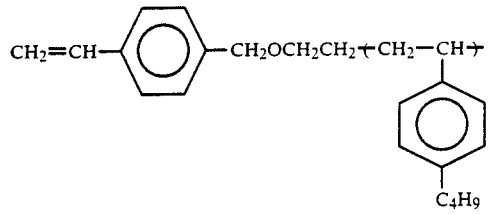

(B)-23

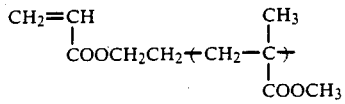

(B)-24

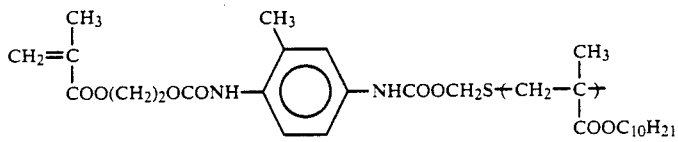

(B)-25

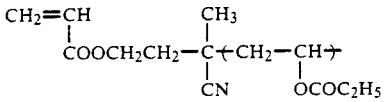

(B)-26

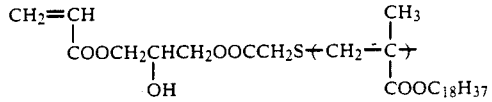

(B)-27

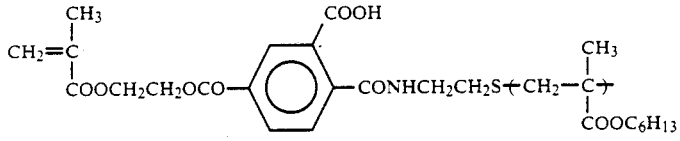

(B)-28

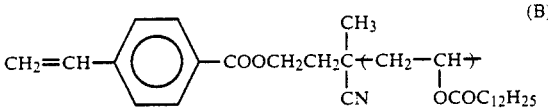

(B)-29

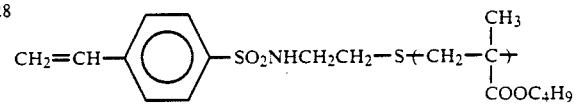

(B)-30

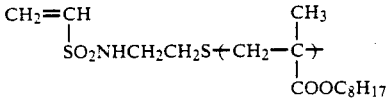

(B)-31

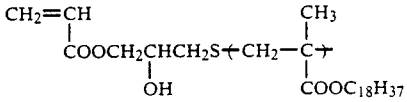

(B)-32

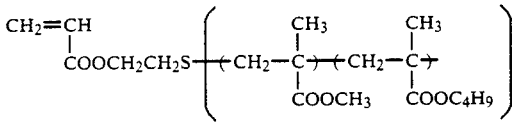

(B)-33

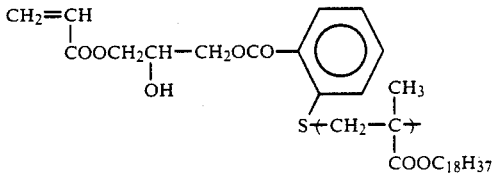

(B)-34

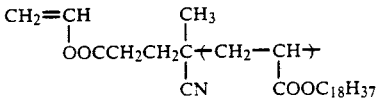

The dispersed resins of this present invention comprise at least one monomer (A) and at least one macromonomer (B), and here an important point is that the prescribed dispersed resins are obtained provided that the resin comprising these monomers is insoluble in that non-aqueous solvents. More specifically, the amount of the macromonomer (B) used is preferably from 0.1 to 10 wt %, and more preferably from 0.2 to 5 wt %, with respect to the insolubilized monomer (A). Most preferably, the amount used is within the range from 0.3 to 3 wt %. Furthermore, the molecular weight of the dispersed resin of this present invention is from $10^3$ to $10^6$, and most desirably from $10^4$ to $5\times10^5$.

As described above, the dispersed resins used in this invention can be prepared, in general, by the polymerization with heat of a resin for dispersion stabilization purposes as described earlier, a monomer (A) and a macromonomer (B) in a non-aqueous solvent in the presence of a polymerization initiator such as benzoyl peroxide, azobisisobutyronitrile or butyl lithium, for example.

More specifically, the dispersed resin can be prepared using methods in which a polymerization initiator is added to a solution containing a mixture of resin for dispersion stabilization purposes, monomer (A) and macromonomer (B), methods in which monomer (A and macromonomer (B) are drip fed along with a polymerization initiator into a solution which contains the resin for dispersion stabilization purposes, methods in which part of a mixture of the monomer (A) and the macromonomer (B) is dissolved with all of the resin for dispersion stabilization purposes to form a solution to which the remainder of the monomer mixture is added arbitrarily, together with the polymerization initiator, and methods in which a mixture of the resin for dispersion stabilization purposes and monomer are added arbitrarily together with the polymerization initiator to a non-aqueous solvent.

The total amount of monomer (A) and macromonomer (B) is within the range from about 5 to 80 parts by weight, and preferably from 10 to 50 parts by weight, per 100 parts by weight of non-aqueous solvent.

The soluble resin which is the dispersion stabilizing agent is used at a rate of from 1 to 100 parts by weight, and preferably at a rate of from 5 to 50 parts by weight, per 100 parts of all the above mentioned monomer which is used.

The amount of polymerization initiator is suitably from 0.1% to 5% (by weight) with respect to the total amount of monomer.

The polymerization temperature is from 50° C. to 180° C., and preferably from 60° C. to 120° C. The reaction time is preferably from 1 to 15 hours.

Where polar solvents, such as the aforementioned alcohols, ketones, ethers or esters for example, are used conjointly with the non-aqueous solvents used in the reaction, and which unreacted monomer (A) which is being polymerized to form particles remains after reaction, the solvent or monomer is preferably distilled off by increasing the temperature above the boiling point of the solvent or monomer, or by distillation under reduced pressure.

The non-aqueous latex particles prepared in accordance with this present invention in the manner described above exist as fine particles which have a uniform particle size distribution, and, at the same time, they exhibit very stable dispersion properties, dispersion being especially good with long term repetitive use in a developing apparatus. Moreover, the particles are easily redispersed, even with increased developing speeds, and no attachment to various parts of the apparatus and contamination is observed at all.

Furthermore, when fixed by heating, for example, they form a strong film and they exhibit excellent fixing properties.

Moreover, the liquid developers of this present invention have excellent dispersion stability, redispersion properties and fixing properties even when they are used in rapid development/fixing processes and for large size master plates.

Coloring agents may be used, as desired, in the liquid developers of this invention.

No particular limitation is imposed upon the coloring agent, and a variety of conventional pigments and dyes can be used for this purpose.

Where the dispersed resin is to be colored itself, the coloration can be achieved, for example, by physical dispersion within the dispersed resin using pigments or dyes, and there are many known pigments and dyes which can be used for this purpose. Examples include magnetic iron oxide powder, powdered lead iodide, carbon black, nigrosine, alkali blue, hanza yellow, quinacridone red and phthalocynaine blue.

The method in which the dispersed resins are dyed with the preferred dyes, as disclosed, for example, in JP-A-57-48738, is another method for coloration. Alternatively, dyes can be chemically bonded with the dispersed resin, as disclosed in JP-A-53-54029, or monomer which contains a pre-colorant can be used when preparing the polymerized particles to provide a colorant containing copolymer as disclosed, for example, in JP-B-44-22955. (The term "JP-B" as used herein signifies an "examined Japanese patent publication".)

Various additives can be present, as required, in the liquid developers of this invention to reinforce charging characteristics or to improve image characteristics, for example, and specific examples of such additives are disclosed in Harazaki, *Electrophotography*, Vol. 16, No. 2, page 44.

For example, metal salts of di-2-ethylhexylsulfosuccinic acid, metal naphthenates, metal salts of higher fatty acids, lecithin, polyvinylpyrrolidone and copolymers which contain a hemi-maleic acid amide components can be used.

The amounts of each of the principal components in a liquid developer of this invention are indicated below.

Toner particles of which a resin, with a colorant as required, forms the principal component are preferably present at a rate of from 0.5 to 50 parts by weight per 1,000 parts by weight of carrier liquid. If the amount is less than 0.5 parts by weight the image density obtained is unsatisfactory, and if more than 50 parts by weight is present then fogging tends to occur in the non-image areas. Moreover, the aforementioned carrier liquid soluble resin for dispersion stabilization purposes can also be used, as required, and it can be employed at rate ranging from 0.5 to 100 parts by weight per 1,000 parts by weight of carrier liquid. The charge control agents of the type referred to above are preferably present at a rate of from 0.001 to 1.0 part by weight per 1,000 parts by weight of carrier liquid. Moreover, various additives may be employed, as required, and the total amount of these additives is limited only by the upper level by the electrical resistance of the developer. That is to say, it is difficult to obtain good quality continuous tone images if the electrical resistance of the liquid developer without the toner particles present is use than 10Ω cm and so the amount of the various additives present must be controlled within these limits.

Illustrative examples of the invention are described below, but the invention is not to be construed as being limited by these examples. Unless otherwise indicated all parts, percents, ratios and the base weight.

SYNTHESIS EXAMPLE 1

PREPARATION OF RESIN FOR DISPERSION STABILIZATION PURPOSES

Preparation of Resin P-1 for Dispersion Stabilization Purposes

A liquid mixture of 97 grams of octadecyl methacrylate, 3 grams of thioglycolic acid, 0.5 grams of divinylbenzene and 200 grams of toluene was heated to 85° C. with agitation under a blanket of nitrogen. Next, 0.8 gram of 1,1'-azobis(cyclohexane-1-carbonitrile) (referred to hereinafter as "A.C.H.N.") was added. The mixture was reacted for a period of 4 hours, after which 0.4 gram of A.C.H.N. was added and the mixture was reacted for a period of 2 hours, after which a further 0.2 gram of A.C.H.N. was added and the mixture was reacted for a period of 2 hours. After cooling, the reaction mixture was reprecipitated in 1.5 liters of methanol. A white powder was recovered by filtration and dried to provide 88 grams of powder. The weight average molecular weight of the polymer obtained was 30,000.

SYNTHESIS EXAMPLE 2-9

PREPARATION OF RESIN FOR DISPERSION STABILIZATION PURPOSES

Preparation of Resins P-2-P-9 for Dispersion Stabilization Purposes

These resins for dispersion stabilization purposes were prepared using the same procedure as described in Synthesis Example 1 except that the monomers indicated in Table 1 below were used instead of octadecyl methacrylate.

TABLE 1

| Synthesis Example | Resin for Dispersion Stabilization Purposes | Monomer | | Weight Average Molecular Weight |
|---|---|---|---|---|
| 2 | P-2 | Dodecyl methacrylate | 97 g | 32,000 |
| 3 | P-3 | Tridecyl methacrylate | 97 g | 31,000 |
| 4 | P-4 | Octyl methacrylate | 17 g | 29,000 |
| | | Dodecyl methacrylate | 80 g | |
| 5 | P-5 | Octadecyl methacrylate | 70 g | 33,000 |
| | | Butyl methacrylate | 27 g | |
| 6 | P-6 | Dodecyl methacrylate | 92 g | 34,000 |
| | | N,N-Dimethyl-aminoethyl methacrylate | 5 g | |
| 7 | P-7 | Octadecyl methacrylate | 93 g | 29,000 |
| | | 2-(Trimethoxy-silyloxy)ethyl methacrylate | 4 g | |
| 8 | P-8 | Hexadecyl methacrylate | 97 g | 31,000 |
| 9 | P-9 | Tetradecyl methacrylate | 97 g | 32,000 |

SYNTHESIS EXAMPLES 10-22

PREPARATION OF RESIN FOR DISPERSION STABILIZATION PURPOSES

Preparation of Resins P-10-P-22 for Dispersion Stabilization Purposes

These resins for dispersion stabilization purposes were prepared using the same procedure as described in Synthesis Examples 1 except that the polyfunctional monomers or oligomers shown in Table 2 below were used instead of the 5 grams of divinyl-benzene, the polyfunctional monomer for crosslinking purposes, in Synthesis Example 1.

TABLE 2

| Synthesis Example | Resin for Dispersion Stabilization Purposes | Monomer or Oligomer for Crosslinking Purposes | Amount Used | Weight Average Molecular Weight |
|---|---|---|---|---|
| 10 | P-10 | Ethylene glycol dimethacrylate | 4 g | 35,000 |
| 11 | P-11 | Diethylene glycol dimethacrylate | 4.5 g | 29,000 |
| 12 | P-12 | Vinyl methacrylate | 6 g | 40,000 |
| 13 | P-13 | Isopropenyl methacrylate | 6 g | 33,000 |
| 14 | P-14 | Divinyl adipate | 8 g | 32,000 |
| 15 | P-15 | Diallyl glutaconic acid | 10 g | 30,000 |
| 16 | P-16 | ISP-22GA made by the Okamura Seiyu KK) | 10 g | 45,000 |
| 17 | P-17 | Triethylene glycol diacrylate | 2 g | 50,000 |
| 18 | P-18 | Trivinyl benzene | 2 g | 55,000 |
| 19 | P-19 | Polyethylene glycol #400 diacrylate | 5 g | 38,000 |
| 20 | P-20 | Polyethylene glycol dimethacrylate | 6 g | 40,000 |
| 21 | P-21 | Trimethylol-propane triacrylate | 1.8 g | 56,000 |
| 22 | P-22 | Polyethylene glycol #600 diacrylate | 6 g | 35,000 |

SYNTHESIS EXAMPLE 23

PREPARATION OF RESIN FOR DISPERSION STABILIZATION PURPOSES

Preparation of Resins P-23 for Dispersion Stabilization Purposes

A liquid mixture of 97 grams of octadecyl methacrylate, 3 grams of thiomalic acid, 4.5 grams of divinyl benzene, 150 grams of toluene and 50 grams of ethanol was heated to 60° C. under a blanket of nitrogen. Next, 0.5 gram of 2,2'-azobis(isobutyronitrile) (referred to hereinafter as "A.I.B.N.") was added. The mixture was reacted for period of 5 hours, after which 0.3 grams of A.I.B.N. was added and the mixture was reacted for a period of 3 hours, after which a further 0.2 gram of A.I.B.N. wad added and the mixture was reacted for a period of 3 hours. After cooling, the reaction mixture was reprecipitated in 2 liters of methanol. A white powder was recovered by filtration and dried. A polymer of a weight average molecular weight of 35,000 was obtained with a recovery of 85 grams.

SYNTHESIS EXAMPLES 24-29

PREPARATION OF RESIN FOR DISPERSION STABILIZATION PURPOSES

Preparation of Resins P-24-P-29 for Dispersion Stabilization Purposes

These resins for dispersion stabilization purposes were prepared using the same procedure as described in Synthesis Example 23 except that the mercapto compounds indicated in Table 3 below were used instead of the 3 grams of thiomalic acid used in Synthesis Example 23.

TABLE 3

| Synthesis Example | Resin for Dispersion stabilization Purposes | Mercapto Compound | Weight Average Molecular Weight |
|---|---|---|---|
| 24 | P-24 | $HSCH_2CH_2COOH$ | 36,000 |
| 25 | P-25 | 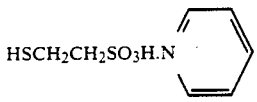 | 29,000 |
| 26 | P-26 | 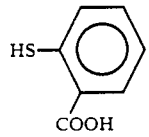 | 38,000 |
| 27 | P-27 | 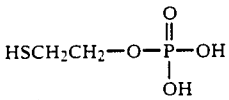 | 33,000 |
| 28 | P-28 | $HSCH_2CH_2NHCO(CH_2)_2COOH$ | 37,000 |
| 29 | P-29 | $HSCH_2CH_2NHCH_2CH_2COOH$ | 35,000 |

SYNTHESIS EXAMPLE 30

PREPARATION OF RESIN FOR DISPERSION STABILIZATION PURPOSES

Preparation of Resins P-30 for Dispersion Stabilization Purposes

A mixture of 94 grams of hexadecyl methacrylate, 1.0 gram of diethylene glycol dimethacrylate, 150 grams of toluene and 50 grams of isopropyl alcohol was heated to 90° C. under a blanket of nitrogen. Next, 6 grams of 2,2'-azobis(4-cyano-valerianic acid) referred to hereinafter as "A.C.V." was added and the mixture reacted for period of 8 hours. After cooling, the reaction mixture was reprecipitated in 1.5 liters of methanol. A white powder was recovered by filtration and dried. A polymer of a weight average molecular weight of 65,000 was obtained with a recovery of 83 grams.

SYNTHESIS EXAMPLE 31

PREPARATION OF RESIN FOR DISPERSION STABILIZATION PURPOSES

Preparation of Resins P-31 for Dispersion Stabilization Purposes

A liquid mixture of 92 grams of docosanyl methacrylate, 1.5 grams of ISP-22GA (made by the Okamura Seiyu Co.), 150 grams of toluene and 50 grams of ethanol was heated to 80° C. under a blanket of nitrogen. Next, 8 grams of 4,4'-azobis(4-cyanopentanol) was added and the mixture was reacted for period of 8 hours. After cooling, the reaction mixture was reprecipitated in 1.5 liters of methanol. A white powder was recovered by filtration and dried. A polymer of a weight average molecular weight of 41,000 was obtained with a recovery of 78 grams.

SYNTHESIS EXAMPLE 32

PREPARATION OF RESIN FOR DISPERSION STABILIZATION PURPOSES

Preparation of Resins P-32 for Dispersion Stabilization Purposes

A liquid mixture of 95 grams of octadecyl methacrylate, 5 grams of divinylbenzene and 200 grams of toluene was heated to 85° C. under a blanket of nitrogen Next, 0.7 gram A.C.H.N. was added and the mixture reacted for period of 8 hours.

Next, 8 grams of glutaconic acid anhydride and 1 ml of concentrated sulfuric acid were added and the mixture was reacted at 100° C. for a period of 6 hours. After cooling, the reaction mixture was reprecipitated in 1.5 liters of methanol. A white powder was recovered by filtration and dried. A polymer of a weight average molecular weight of 31,000 was obtained with a recovery of grams.

SYNTHESIS EXAMPLE 33

PREPARATION OF RESIN FOR DISPERSION STABILIZATION PURPOSES

Preparation of Resins P-33 for Dispersion Stabilization Purposes

A liquid mixture of 95 grams of octadecyl methacrylate, 3 grams of thioglycolic acid, 6 grams of ethylene glycol dimethacrylate, 150 grams of toluene and 50 grams of ethanol was heated to 80° C. under a blanket of nitrogen. Next, 2 grams A.C.V. was added and the mixture was reacted for period of 4 hours, after which a further 0.5 gram of A.C.V. was added and the mixture was reacted for a period of 4 hours. After cooling, the reaction mixture was reprecipitated in 1.5 liters of methanol. A white powder was recovered by filtration and dried. A polymer of a weight average molecular weight of 35,000 was obtained with a recovery of 80 grams.

SYNTHESIS EXAMPLE 34

PREPARATION OF RESIN FOR DISPERSION STABILIZATION PURPOSES

Preparation of Resins P-34 for Dispersion Stabilization Purposes

A liquid mixture of 94 grams of tridecyl methacrylate, 6 grams of 2-mercaptoethanol, 9 grams of divinyl benzene, 150 grams of toluene and 50 grams of ethanol was heated to 80° C. under a blanket of nitrogen. Next, 4 grams A.C.H.N. was added and the mixture was reacted for period of 4 hours, after which a further 2 grams of A.C.H.N. was added and the mixture was reacted for a period of 4 hours.

After cooling, the reaction mixture was reprecipitated in 1.5 liters of methanol, the methanol was removed by decantation and the remaining sticky material was dried. A polymer of a weight average molecular weight of 29,000 was obtained with a recovery of 75 grams.

SYNTHESIS EXAMPLE 35

PREPARATION OF RESIN FOR DISPERSION STABILIZATION PURPOSES

Preparation of the Resins P-35 for Dispersion Stabilization Purposes

A mixture of 50 grams of the above mentioned Resin P-34 for dispersion stabilization purposes, 100 grams of toluene, 10 grams of succinic acid anhydride and (.5 gram of pyridine was heated to 90° C. and reacted for a period of 10 hours. After cooling, the reaction mixture was reprecipitated in 0.8 liter of methanol, the methanol was removed by decantation and the remaining sticky material was dried. A polymer of a weight average molecular weight of 30,000 was obtained with a recovery of 43 grams.

SYNTHESIS EXAMPLES 36–39

PREPARATION OF RESIN FOR DISPERSION STABILIZATION PURPOSES

Preparation of Resins P-36–P-39 for Dispersion Stabilization Purposes

These resins for dispersion stabilization purposes were prepared using the same procedure as described in Synthesis Example 35 except that the dicarboxylic acid anhydrides indicated in Table 4 below wee used instead of the succinic acid anhydride used in Synthesis Example 35 for the preparation of Resin P-35 for dispersion stabilization purposes.

TABLE 4

| Synthesis Example | Resin for Dispersion Stabilization Purposes | Dicarboxylic Acid Anhydride | Amount Used | Weight Average Molecular Weight |
|---|---|---|---|---|
| 36 | P-36 | Maleic acid anhydride | 8.5 g | 30,000 |
| 37 | P-37 | Adipic acid anhydride | 11 g | 30,000 |
| 38 | P-38 | Phthalic acid anhydride | 10 g | 30,000 |
| 39 | P-39 | Trimelitic acid anhydride | 12.5 g | 30,000 |

SYNTHESIS EXAMPLE 40

PREPARATION OF RESIN FOR DISPERSION STABILIZATION PURPOSES

Preparation of Resins P-40 for Dispersion Stabilization Purposes

A mixture of 86 grams of octadecyl methacrylate, 10 grams of N-methoxymethylacrylamide, 4 grams of thioglycolic acid, 150 grams of toluene and 50 grams of iso-propanol was heated to 80° C. under a blanket of nitrogen.

Next, 0.8 gram of A.C.H.N. was added and the mixture was reacted for period of 8 hours, after which the mixture was heated to 110° C. and agitated for 6 hours in a Dean and Stark apparatus. The iso-propanol solvent used and the methanol which formed as a by-product of the reaction were removed.

After cooling, the reaction mixture was reprecipitated in 1.5 liters of methanol and a white powder was recovered by filtration and dried. A polymer of a weight average molecular weight of 45,000 was obtained with a recovery of 82 grams.

SYNTHESIS EXAMPLE 41

PREPARATION OF MACROMONOMER

Preparation of Macromonomer M-1

A liquid mixture of 92 grams of methyl methacrylate, 5 grams of thioglycolic acid and 200 grams of toluene was heated to 75° C. with agitation under a blanket of nitrogen, after which 31 grams of 2,2'-azobis(-cyanovalerinanic acid) (referred to hereinafter as "A.C.V.") was added and the mixture was reacted for a period of 8 hours. Next, 8 grams of glycidyl methacrylate, 1.0 gram of N,N-dimethyldodecylamine and 0.5 gram of tertbutylhydroquinone were added to the reaction mixture which was subsequently agitated for a period of 12 hours at a temperature of 100° C. After cooling, the reaction mixture was reprecipitated in 2 liters of methanol and 82 grams of a white powder was obtained. The number average molecular weight of the polymer was 6,500.

SYNTHESIS EXAMPLE 42

PREPARATION OF MACROMONOMER

Preparation of Macromonomer M 2

A liquid mixture of 95 grams of methyl methacrylate, 5 grams of thioglycollic acid and 200 grams of toluene was heated to 70° C. with agitation under a blanket of nitrogen, 1.5 grams of 2,2'-azobis(isobutyronitrile) (referred to hereinafter as "A.I.B.N.") was added and the mixture was reacted for 8 hours. Next, 7.5 grams of glycidyl methacrylate, 1.0 gram of N,N-dimethyldodecylamine and 0.8 gram of tert-butylhydroquinone were added to the reaction mixture which was subsequently agitated for 12 hours at 100° C. After cooling, the reaction mixture was reprecipitated in 2 liters of methanol and 85 grams of a colorless, transparent, sticky material was obtained. The number average molecular weight of the polymer was 2,400.

SYNTHESIS EXAMPLE 43

PREPARATION OF MACROMONOMER

Preparation of Macromonomer M-3

A liquid mixture of 94 grams of methyl methacrylate, 6 grams of 2-mercaptoethanol and 200 grams of toluene was heated to 70° C. under a blanket of nitrogen, 1.2 grams of A.I.B.N. was added and the mixture was reacted for a period of 8 hours.

Next, the reaction mixture was cooled to 20° C. in a water bath, 10.2 grams of triethylamine was added and then 14.5 grams of methacrylic acid chloride was added dropwise in such a way that the temperature did not exceed 25° C. The mixture was agitated under the same conditions for a further period of 1 hours after the dropwise addition had been completed, after which 0.5 gram of t-butylhydroquinone was added, the temperature was raised to 60° C. and the reaction mixture was agitated for a period of 4 hours. After cooling, the reaction mixture was reprecipitated in 2 liters of methanol and 79 grams of a colorless, transparent sticky material was obtained. The number average molecular weight was 4,500.

SYNTHESIS EXAMPLE 44

REPARATION OF MACROMONOMER

Preparation of Macromonomer M-4

A liquid mixture of 95 grams of hexyl methacrylate and 200 grams of toluene was heated to 70° C. under a blanket of nitrogen, 5 grams of 2,2'-azobis(cyanoheptanol) was added and the mixture was reacted for a period of 8 hours.

After cooling, the reaction mixture was adjusted to a temperature of 20° C. in a water bath, 1.0 gram of triethylamine and 21 grams of methacrylic acid anhydride were added and, after agitating for 1 hour, the mixture was agitated at 60° C. for a period of 6 hours.

The reaction mixture obtained was cooled and then reprecipitated in 2 liters of methanol whereupon 75 grams of a colorless, transparent, sticky material was obtained. The number average molecular weight was 6,200.

SYNTHESIS EXAMPLE 45

PREPARATION OF MACROMONOMER

Preparation of Macromonomer M-5

A mixture of 93 grams of dodecyl methacrylate, 7 grams of 3-mercaptopropionic acid, 170 grams of toluene and 30 grams of iso-propanol was heated to 70° C. under a blanket of nitrogen and a uniform solution was obtained. Next, 2.0 grams of A.I.B.N. was added and the mixture was reacted for a period of 8 hours. After cooling, the reaction mixture was reprecipitated in 2 liters of methanol and the solvent was removed by heating to 50° C. under reduced pressure. The sticky material so obtained was dissolved in 200 grams of toluene, 16 grams of glycidyl methacrylate, 1.0 gram of N,N-dimethyldodecylamine and 1.0 gram of t-butylhydroquinone were added to the solution so obtained and the mixture was agitated at 110° C. for a period of 10 hours. The reaction mixture was then again reprecipitated in 2 liters of methanol. The number average molecular weight of the light yellow colored sticky material so obtained was 3,400.

SYNTHESIS EXAMPLE 46

PREPARATION OF MACROMONOMER

Preparation of Macromonomer M-6

A mixture of 95 grams of octadecyl methacrylate, 5 grams of thioglycolic acid and 200 grams of toluene was heated to 75° C. with agitation under a blanket of nitrogen, 1.5 grams of A.I.B.N. was added and the mixture was reacted for a period of 8 hours. Next, 13 grams of glycidyl methacrylate, 1.0 gram of N,N-dimethyldodecylamine and 1.0 gram of tert-butylhydroquinone were added and the mixture was agitated at 110° C. for a period of 10 hours. After cooling, the reaction mixture was reprecipitated in 2 liters of methanol and 86 grams of a white powder was obtained. The number average molecular weight was 2,300.

SYNTHESIS EXAMPLE 47

PREPARATION OF MACROMONOMER

Preparation of Macromonomer M-7

A mixture of 40 grams of methyl methacrylate, 54 grams of ethyl methacrylate, 6 grams of 2-mercaptoethylamine, 150 grams of toluene and 50 grams of tetrahydrofuran was heated to 75° C. with agitation under a blanket of nitrogen, 2.0 grams of A.I.B.N. was added and the mixture was reacted for a period of 8 hours. The reaction mixture was then cooled to 20° C. in a water bath, 23 grams of methacrylic acid anhydride was added dropwise in such a way that the temperature did not exceed 25° C. and the mixture was subsequently agitated for a period of 1 hour under the same conditions. Next, 0.5 gram of 2,2'-methylenebis(6-tert-butyl-p-cresol) was added and the mixture was agitated at 40° C. for a period of 3 hours. After cooling, the liquid was reprecipitated in 2 liters of methanol and 83 grams of a sticky material was obtained. The number average molecular weight was 2,200.

SYNTHESIS EXAMPLE 48

PREPARATION OF MACROMONOMER

Preparation of Macromonomer M-8

A liquid mixture of 95 grams of methyl methacrylate and 200 grams of toluene was heated to 75° C. under a blanket of nitrogen, 5 grams of A.C.V. was added and the mixture was reacted for a period of 8 hours. Next, 15 grams of glycidyl acrylate, 1.0 gram of N,N-dimethyldodecylamine and 1.0 gram of 2,2'-methylenebis(6-tert-butyl-p-cresol) were added and the mixture was agitated at 100° C. for a period of 15 hours. After cooling, the reaction mixture was reprecipitated in 2 liters of methanol and 83 grams of a transparent, sticky material was obtained. The number average molecular weight was 3,600.

SYNTHESIS EXAMPLE 49

PREPARATION OF LATEX PARTICLES

Preparation of D-1 Latex Particles

A liquid mixture of 12 grams of Resin P-1 obtained in Synthesis Example of the preparation of resin for dispersion stabilization purposes, 100 grams of vinyl acetate, 1.0 gram of the Macromonomer M-1 obtained in Synthesis Example 41 of the preparation of macromonomer and 380 grams of "Isopar H" was heated to 75° C. with agitation under a blanket of nitrogen, after which 1.7 grams of A.I.B.N. was added and the mixture was reacted for a period of 6 hours. A white turbidity appeared 20 minutes after the addition of the initiator and the temperature rose to 88° C. The temperature was then increased to 100° C. and the mixture was agitated for a period of 2 hours and the unreacted vinyl acetate was removed by distillation. After cooling, the reaction mixture was passed through a 200 mesh nylon cloth and the white colored dispersion so obtained formed a latex of average particle size 0.20 μm at a polymerization factor of 90%.

SYNTHESIS EXAMPLES 50-59

PREPARATION OF LATEX PARTICLES

Preparation of D-2-D-11 Latex Particles

These were prepared using the same procedure as in Synthesis Example 49 of the preparation of latex particles except that the compounds indicated in Table 5 below were used instead of Resin P-1 for dispersion stabilization purposes and Macromonomer M-1 used in Synthesis Example 41 of the preparation of latex particles. White dispersions with polymerization factors 84%-90% were obtained.

TABLE 5

| Synthesis Example | Latex Particles | Resin for Dispersion Stabilization Purposes | Macro-monomer | Average Particle Size of the Latex Particles |
|---|---|---|---|---|
| 50 | D-2 | P-2 | M-1 | 0.19 μm |
| 51 | D-3 | P-2 | M-2 | 0.22 |
| 52 | D-4 | P-2 | M-4 | 0.23 |
| 53 | D-5 | P-2 | M-5 | 0.20 |
| 54 | D-6 | P-2 | M-6 | 0.21 |
| 55 | D-7 | P-3 | M-1 | 0.18 |
| 56 | D-8 | P-4 | M-7 | 0.19 |
| 57 | D-9 | P-5 | M-8 | 0.20 |
| 58 | D-10 | P-8 | M-2 | 0.19 |
| 59 | D-11 | P-9 | M-1 | 0.20 |

SYNTHESIS EXAMPLE 60

PREPARATION OF LATEX PARTICLES

Preparation of D-12 Latex Particles

A liquid mixture of 13 grams of Resin P-2 obtained in Synthesis Example 2 of preparation of a resin for dispersion stabilization purposes, 100 grams of vinyl acetate, 5 grams of crotonic acid, 1.0 gram of Macromonomer M-1 obtained in Synthesis Example 41 of the preparation of a macromonomer and 468 grams of "Isopar E" was heated to 70° C. with agitation under a blanket of nitrogen. Next, 1.3 grams of 2,2'-azobis(isovaleronitrile) (referred to hereinafter as A.I.V.N.) was added and, after reacting for a period of 6 hours, the temperature was increased to 100° C. and the mixture was agitated at this temperature for a period of 1 hour. The residual vinyl acetate was removed by distillation. After cooling, the mixture was passed through a 200 mesh nylon cloth and the white dispersion so obtained was a latex with a polymerization factor of 85% and an average particle size of 0.21 μm.

SYNTHESIS EXAMPLE 61

PREPARATION OF LATEX PARTICLES

Preparation of D-13 Latex Particles

A liquid mixture of 14 grams of Resin P-1 obtained in Synthesis Example 1 of preparation of a resin for dispersion stabilization purposes, 100 grams of vinyl acetate, 6.0 grams of 4-pentenic acid, 1.5 grams of the Macromonomer M-7 obtained in Synthesis Example 47 of the preparation of macromonomer and 380 grams "Isopar 3" was heated to 75° C. with agitation under a blanket of nitrogen. Next, 0.7 grams of A.I.B.N. was added and the mixture was reacted for a period of 4 hours, after which 0.5 gram of A.I.B.N. was added and the mixture was reacted for a further period of 2 hours. After cooling, the reaction mixture was passed through a 200 mesh nylon cloth and the white dispersion so obtained formed a latex of average particle size 0.24 μm.

SYNTHESIS EXAMPLE 62

PREPARATION OF LATEX PARTICLES

Preparation of D-14 Latex Particles

A liquid mixture of 14 grams of Resin P-2 obtained in Synthesis Example 2 of the preparation of resin for dispersion stabilization purposes, 85 grams of vinyl acetate, 15 grams of N-vinylpyrrolidone, 1.2 grams of Macromonomer M-1 obtained in Synthesis Example 41 of the preparation of macromonomer and 380 grams of n-decane was heated to 75° C. with agitation under a blanket of nitrogen. Next, 1.7 grams of A.I.B.N. was added and the mixture was reacted for a period of 4 hours, after which 0.5 gram of A.I.B.N. was added and the mixture was reacted for a further period of 2 hours. After cooling, the reaction mixture was passed through a 200 mesh nylon cloth and the white dispersion so obtained formed a latex of average particle size 0.25 μm.

SYNTHESIS EXAMPLE 63

PREPARATION OF LATEX PARTICLES

Preparation of D-15 Latex Particles

A liquid mixture of 18 grams of Resin P-1 obtained in Synthesis Example 1 of the preparation of resin for dispersion stabilization purposes, 100 grams of methyl methacrylate, 1.5 grams of Macromonomer M-2 obtained in Synthesis Example 42 of the preparation of macromonomer and 470 grams of n-octane was heated to 70° C. with agitation under a blanket of nitrogen. Next, 1.0 grams of A.I.V.N. was added and the mixture was reacted for a period of 2 hours. A bluish-white turbidity started to appear a few minutes after the introduction of the initiator and the temperature rose to 90° C. After cooling, the reaction mixture was passed through a 200 mesh nylon cloth and the white dispersion so obtained formed a latex of average particle size 0.35 μm.

SYNTHESIS EXAMPLE 64

PREPARATION OF LATEX PARTICLES

Comparative Example A

The procedure described in Synthesis Example 49 for the preparation of latex particles was followed except that Macromonomer M-1 was omitted. The white dispersion so obtained was a latex of average particle size 0.20 μm with a polymerization factor of 85%.

SYNTHESIS EXAMPLE 65

PREPARATION OF LATEX PARTICLES

Comparative Example B

The procedure described in Synthesis Example 49 for the preparation of latex particles was followed except that 1.0 grams of octadecyl methacrylate was used instead of Macromonomer M-1. The white dispersion so obtained was a latex of average particle size 0.22 μm with a polymerization factor of 85%.

SYNTHESIS EXAMPLE 66

PREPARATION OF LATEX PARTICLES

Comparative Example C

The procedure described in Synthesis Example 49 for the preparation of latex particles was followed except that 1 gram of the monomer of which the structure is indicated below was used instead of Macromonomer M.1. The white dispersion so obtained was a latex of average particle size 0.22 μm with a polymerization factor of 86%.

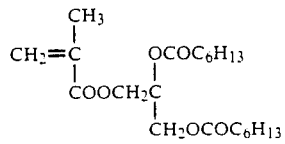

Monomer (I)

EXAMPLE 1

Ten grams of dodecyl methacrylate/acrylic acid copolymer (copolymer ratio 95/5, by weight), 10 grams of nigrosine and 30 grams of "Shellsol 71" were introduced together with glass beads into a paint shaker (Tokyo Seiki Co.) and a fine dispersion of nigrosine was obtained by dispersing the mixture for a period of 4 hours.

A liquid developer for electrophotographic purposes was then prepared by diluting 30 grams of the Resin Dispersion D-1 from Synthesis Example 49 of the preparation of latex particles, 2.5 grams of the above mentioned nigrosine dispersion, 15 grams of the higher alcohol FOC-1400 (manufactured by the Nissan Kagaku Co.) and 0.08 gram of an octadecyl vinyl ether/hemimaleic acid octadecylamide copolymer with 1 liter of "Shellsol 71".

Comparative Developers (A–C)

Three types of liquid developer for comparative purposes, namely Liquid Developers A, B and C, were prepared by substituting the Resin Dispersions indicated below for the resin dispersion D-1 in the example of the preparation of a liquid developer described above.

Comparative Liquid Developer A:
The resin dispersion of Synthesis Example 64 of the preparation of latex particles.

Comparative Liquid Developer B:
The resin dispersion of Synthesis Example 65 of the preparation of latex particles.

Comparative Liquid Developer C:
The resin dispersion of Synthesis Example 66 of the preparation of latex particles.

These liquid developers were used as developers in a fully automatic plate making machine model ELP404V (made by the Fuji Photo Film Co., Ltd.) in which ELP Master Type II electrophotographic photosensitive material (made by the Fuji Photo Film Co., Ltd.) was exposed and developed. The plate making process was carried out at a speed of 6 plates per minute. Moreover, whether or not toner attachment and contamination of the developing apparatus had occurred was determined after processing 2,000 ELP Master type II plates. An evaluation of blackening (image area) of the copy image was carried out using an original documents having 40% image area. The results obtained were shown in Table 6.

TABLE 6

| No. | Experiment | Developer | Contamination of Developing Apparatus | Image Quality of 2000th Plate |
|---|---|---|---|---|
| 1 | invention | Example 1 | ○ No toner contamination | ○ Clear |
| 2 | Comparative Example A | Developer A | XXX Pronounced toner contamination | X Text drop out, uneven blocked parts, base fogging |
| 3 | Comparative Example B | Developer B | X Toner contamination | Δ Breaks seen in fine lines Low $D_{max}$ |
| 4 | Comparative Example C | Developer C | X Toner contamination | Δ Breaks seen in fine lines Low $D_{max}$ |

When printing plates were made using each developer under the aforementioned plate making conditions, only the developer of this invention did not result in contamination of the developing apparatus and, was due to produce clear images after making 2,000 plates.

On the other hand, printing was carried out in the usual way using the master plates for offset printing purposes (ELP masters) obtained by making plates with each developer, and on comparing the numbers of copies printed in each case before any dropout of text or unevenness of blocked parts, for example, occurred in the image on the printed copies, it was found that these phenomena did not occur on printing more than 10,000 copies with the master plates obtained using the developer of this invention or the developers of Comparative Examples A and C, but they did arise on printing 8,000 copies with the master plate obtained using the developer of Comparative Example B.

It is clear from the results described above that only when the developer of this invention was used was it possible to obtain master plates which provided a marked increase in the number of copies which could be obtained with no contamination of the development apparatus at all.

That is to say, in the case of Comparative Example A no problem with the number of copies printed occurred but there was marked contamination of the developing apparatus, thus it could not be used continuously.

Furthermore, in the case of Comparative Examples B and C the development apparatus (and especially the back of the electrode plate) became contaminated when the developers were used at a high plate making speed of 6 plates per minute (the conventional plate making speed is 2 to 3 plates per minute) and there was an effect on the image quality of the image transferred on the plate (a decrease in Dmax and breaks in fine lines) after the production of about 2,000 copies. The number of prints with the master plate was not a problem in Comparative Example C but there was a reduction in the number in Comparative Example B.

These results show that the resin particles of this present invention are clearly superior.

EXAMPLE 2

A mixture of 100 grams of the white Latex Dispersion D-1 obtained in Synthesis Example 49 of the preparation of latex particles and 1.5 grams of "Sumicron Black" was heated to 100° C. and agitated with heating for a period of 4 hours. After cooling to room temperature, the mixture was passed through a 200 mesh nylon cloth and, on removing the residual dye, a black resin dispersion of average particle size 0.2 μm was obtained.

Thirty two grams of the above mentioned black resin dispersion and 0.05 grams of zirconium naphthenate were diluted with 1 liter of "Shellsol 71" to prepare a liquid developer.

When development was carried out with this liquid developer using the same apparatus as used in Example 1, no toner attachment and contamination of the apparatus at all occurred even after developing 2,000 plates.

Furthermore, the image quality of the master plates for offset printing purposes obtained was clear and the image quality of the printed material was also very clear after printing 10,000 copies.

EXAMPLE 3

A mixture of 100 grams of the white dispersion D-12 obtained in Synthesis Example 60 of the preparation of latex particles and 3 grams of "Victoria Blue 3" was heated to 70° C. to 80° C. and agitated for a period of 6 hours. After cooling to room temperature, the mixture was passed through a 200 mesh nylon cloth, the residual dye was removed, and a blue colored resin dispersion of average particle size 0.21 μm was obtained.

Thirty two grams of the above mentioned blue colored resin dispersion and 0.05 gram of zirconium naphthenate were diluted with 1 liter of "Isopar H" to prepare a liquid developer.

When development was carried out with this liquid developer using the same apparatus as used in Example 1, no toner attachment and contamination of the apparatus at all occurred even after developing 2,000 plates. Furthermore, the image quality of the master plates for offset printing purposes obtained was clear and the image quality of the printed material was also very clear after printing 10,000 copies.

EXAMPLE 4

Thirty two grams of the white Latex Dispersion D-2 obtained in Synthesis Example 50 of the preparation of latex particles, 2.5 grams of the nigrosine dispersion obtained in Example 1, 0.02 gram of a hemi-docosanylamido compound of a di-isobutylene/maleic anhydride copolymer and 15 grams of the higher alcohol FOC-1400 (made by Nissan Kagaku Co.) were diluted with 1 liter of "Isopar G" to prepare a liquid developer.

When development was carried out with this liquid developer using the same apparatus as used in Example 1, no toner attachment and contamination of the apparatus occurred at all even after developing 2,000 plates. Furthermore, the image quality of the master plates for offset printing purposes obtained and the image quality of the printed material after printing 10,000 copies were clear.

Moreover, processing was carried out in the same way after letting the developer stand for a period of 3 months and there was no change with the passage of time.

EXAMPLE 5

Ten grams of poly(decyl methacrylate), 30 grams of "Isopar H" and 8 grams of "Alkali Blue" were introduced together with glass beads into a paint shaker and dispersed for a period of 2 hours to provide a fine dispersion of "Alkali Blue".

Thirty grams of the white Latex Dispersion D-11 obtained in Synthesis Example 59 of the preparation of latex particles, 4.2 grams of the above mentioned "Alkali Blue" dispersion and 0.06 gram of a hemi-docosanylamido compound of a diisobutylene/maleic anhydride copolymer were diluted with 1 liter of "Isopar G" to prepare a liquid developer.

When development was carried out with this liquid developer using the same apparatus as used in Example 1, no toner attachment and contamination of the apparatus occurred at all even after developing 2,000 plates. Furthermore, the image quality of the master plates for offset printing purposes obtained and the image quality of the printed material after printing 10,000 copies were very clear.

EXAMPLE 6-15

Each of the Latex Dispersions D-19–D-28 were prepared in the same manner as described in Synthesis Example 49 of the preparation of latex particles but using the compounds indicated in Table 7 below instead of the Resin P-1 for dispersion stabilization proposes and the Macromonomer M-1 in Synthesis Example 49 of the preparation of latex particles.

Liquid developers of this invention were prepared in the same manner as in Example 1 except that the above mentioned Latex Dispersions D-19 to D-28 were used in place of the Latex Dispersion D-1 used in Example 1.

TABLE 7

| Example | Latex | Polymer for Dispersion Stabilization Purposes (wt % of polymerizable double bond group) | | Macromonomer | Latex Reaction Factor | Latex Average Part. size |
|---|---|---|---|---|---|---|
| 6 | D-19 | P-6 | 3 wt % | (B)-4 | 85% | 0.23 μm |
| 7 | D-20 | P-7 | 3 wt % | (B)-5 | 83% | 0.23 μm |
| 8 | D-21 | P-10 | 4 wt % | (B)-8 | 86% | 0.20 μm |
| 9 | D-22 | P-12 | 5 wt % | (B)-10 | 84% | 0.21 μm |
| 10 | D-23 | P-13 | 5 wt % | (B)-14 | 85% | 0.24 μm |
| 11 | D-24 | P-18 | 2 wt % | (B)-16 | 87% | 0.17 μm |
| 12 | D-25 | P-10 | 3 wt % | (B)-19 | 88% | 0.22 μm |
| 13 | D-26 | P-10 | 3 wt % | (B)-20 | 87% | 0.24 μm |
| 14 | D-27 | P-15 | 4 wt % | (B)-29 | 86% | 0.29 μm |
| 15 | D-28 | P-9 | 4 wt % | (B)-34 | 84% | 0.26 μm |

No toner attachment or contamination of the apparatus was observed even after developing 2,000 plates when development was carried out using the same apparatus as used in Example 1. Furthermore, the image quality of the mater plates for offset printing purposes obtained and the image quality of the printed material after making 10,000 copies were very clear.

Developers which have excellent dispersion stability, redispersion properties and fixing properties are obtained with this invention. In particular, even when the developers are used under very high speed plate making conditions there is no contamination of the developing apparatus and the image quality of the master plates for offset printing purposes obtained and the image quality of the printed material obtained after printing 10,000 copies are very clear.

While the invention has been described in detail and with reference to specific examples thereof, it will be apparent to one skilled in the art that various changes and modifications can be made therein without departing from the spirit and scope thereof.

What is claimed is:

1. A liquid developer for an electrostatic photography comprising a non-aqueous solvent whose electrical resistance is at least $10^9$ Ω cm and whose dielectric constant not more than 3.5 with a resin dispersed wherein the dispersed resin particles are copolymer resin particles obtained by a polymerization reaction, of a solution which contains a monofunctional monomer (A) which is soluble in the non-aqueous solvent but which is rendered insoluble by polymerization and a monofunctional macromonomer (B) whose number average molecular weight is not more that $10^4$ obtained by bonding a polymerizable double bond group represented by the general formula (III) below;

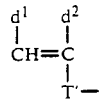

(III)

wherein, T' has the same meaning as T in general formula (II), $d^1$ and $d^2$, which may be the same or different, each has the same meaning as $b^1$ and $b^2$ in general formula (II);

to only one end of the main chain of a polymer comprising repeating units represented by the general formula (II) below;

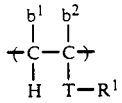

(II)

wherein, T represents —COO—, —OCO—, $—CH_2OCO—$, $—CH_2COO—$, —O—, $—SO_2—$,

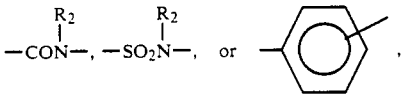

$R_2$ represents a hydrogen atom or a hydrocarbyl group which has from 1 to 18 carbon atoms; $R_1$ represents a hydrocarbyl group which has from 1 to 22 carbon atoms; $b^1$ and $b^2$, which may be the same or different, each represents a hydrogen atom, a halogen atom, a cyano group, a hydrocarbyl group which has from 1 to 8 carbon atoms, a $—COO—R^3$ group or a $—COO—R^3$ group which is linked via a hydrocarbyl group which has from 1 to 8 carbon atoms, and $R^3$ represents a hydrogen atom or a hydrocarbyl group which has from 1 to 18 carbon atoms;

in the presence of a soluble resin for dispersion stabilization purposes obtained by bonding an acid group selected from the group consisting of $—PO_3H_2$, $—SO_3H$, —COOH, —OH, —SH and

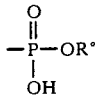

to just one end of at least the polymer main chain of a polymer which has a repeating unit represented by the general formula (I) below;

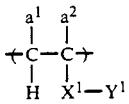

(I)

wherein, $X^1$ represents —COO—, —OCO—, $—CH_2OCO—$, $—CH_2COO—$, —O— or $=SO_2—$;

$Y^1$ represents an aliphatic group which has from 6 to 32 carbon atoms;

moreover, $a^1$ and $a^2$ may be the same or different, each representing a hydrogen atom, halogen atom, cyano group, hydrocarbyl group which has from 1 to 8 carbon atoms, $—COO—Z^1$ or a $—COO—Z^1$ group which is linked via a hydrocarbyl group which has from 1 to 8 carbon atoms (where $Z^1$ represents a hydrocarbyl group which has rom 1 to 22 carbon atoms); and of which a part is cross-linked, in the non-aqueous solvent.

2. The liquid developer according to claim 1, wherein the non-aqueous solvent as a carrier liquid is a linear chain or branched chain aliphatic hydrocarbon, an alicyclic hydrocarbon, an aromatic hydrocarbon, a halogen derivative or a mixture thereof.

3. The liquid developer according to claim 1, wherein $X^1$ is —COO—, —OCO—, $—CH_2OCO—$, $—CH_2COO—$ or —O—, $Y^1$ is an aliphatic group having form 8 to 22 carbon atoms.

4. The liquid developer according to claim 1, wherein $a^1$ and $a^2$, which may be the same or different, each represents a hydrogen atom, a halogen atom, a cyano group, an alkyl group having from 1 to 3 carbon atoms, a $—COO—Z_3$ group or a $—CH_2COO—Z_3$ group where $Z_3$ represents an alkenyl group or an alkyl group.

5. The liquid developer according to claim 1, wherein the amount of the macromonomer (B) is 0.1 to 10 wt. % with respect to the monomer (A).

6. The liquid developer according to claim 1, wherein the weight average molecular weight of the resin for dispersion stabilization purposes is from $1\times10^4$ to $6\times10^5$.

7. The liquid developer according to claim 1, wherein the dispersed resin particles are colored dispersed resin particles.

8. The liquid developer according to claim 1, wherein the dispersed resin particles as toner particles are present in an amount from 0.5 to 50 parts per 1000 parts by weight of the carrier liquid.

9. The liquid developer according to claim 1, wherein the molecular weight of said macromonomer is from $1\times10^3$ to $1\times10^4$.

* * * * *